US009731186B2

(12) United States Patent
Tiede et al.

(10) Patent No.: US 9,731,186 B2
(45) Date of Patent: Aug. 15, 2017

(54) SNOWMOBILE SKI PROTECTOR

(71) Applicants: Lawrence Tiede, Kawkawlin, MI (US); Michael Philips, Beaverton, MI (US); Justin Wark, Beaverton, MI (US)

(72) Inventors: Lawrence Tiede, Kawkawlin, MI (US); Michael Philips, Beaverton, MI (US); Justin Wark, Beaverton, MI (US)

( * ) Notice: Subject to any disclaimer, the term of this patent is extended or adjusted under 35 U.S.C. 154(b) by 0 days.

(21) Appl. No.: 15/099,816

(22) Filed: Apr. 15, 2016

(65) Prior Publication Data

US 2017/0157495 A1 Jun. 8, 2017

Related U.S. Application Data

(63) Continuation of application No. 14/962,256, filed on Dec. 8, 2015.

(51) Int. Cl.
*A63C 5/06* (2006.01)

(52) U.S. Cl.
CPC ..... *A63C 5/062* (2013.01)

(58) Field of Classification Search
CPC ..... A63C 17/002
See application file for complete search history.

(56) References Cited

U.S. PATENT DOCUMENTS 3,261,041 A * 7/1966 Roley ..... B63B 35/812 280/633
4,590,691 A * 5/1986 Oliviero ..... A43B 5/0445 24/641
2007/0182111 A1* 8/2007 Lachance ..... B62B 17/02 280/28

* cited by examiner

*Primary Examiner* — John Walters
*Assistant Examiner* — James Triggs

(57) ABSTRACT

A snowmobile ski protector that packs down the snow in front of the ski to reduce drag. It also protects the front of the ski from wear. It also repairs skis that are already worn out in the front. The present invention also stops worn skis from flexing and causing a snagging hazard.

2 Claims, 6 Drawing Sheets

SNOWMOBILE SKI PROTECTOR

This application is a continuation-in-part application of Ser. No. 14/962,256, filed Dec. 8, 2015, currently pending, from which priority is claimed.

BACKGROUND OF THE INVENTION

The present invention is a snowmobile ski protector. There are many wear bar devices known to the art. Snowmobile skis are subjected to incredible amounts of wear due to the terrain that they are used in. They can go from a well-groomed snow covered trail, ice covered lakes and rivers, to gravel roads. They can even run on asphalt pavement during normal operation of the snow machine.

The present invention also overcomes significant hazards. Worn skis can flex and cause a snagging hazard, it has been discovered that the installation of the present invention on snowmobile skis prevents this. It has also been discovered that the present invention is universal in that it works with any runner that is not greater than one half inch wide. This also gives the device a greater utility than any prior art device.

This invention is not a wear bar. This device mounts forward of the wear bar and protects the wear bar as well as the ski. Besides protecting the ski from excessive wear and tear the snowmobile protector helps to pack down snow in front of the ski which significantly reduces darting. The snowmobile ski protectors also reduce drag. The installation of the ski protector repairs skis that are already worn out. Therefore, the applicant is unaware of any pertinent prior art.

THE INVENTION

The present invention is a ski protector. This ski protector comprises a flat metal plate that has a predetermined thickness, a front end, and a back end.

The flat metal plate is narrower in width than the length of the flat metal plate. The flat metal plate has a top surface and fixedly attached to the top surface, near a center point thereof, of the flat metal plate, is a threaded vertical bolt. The terminal end of the front end of the flat metal plate has an upwardly projecting, forwardly projecting, bent tongue.

The back end has a notch through the top surface of the flat metal plate. The notch extends through the thickness of the flat metal plate.

DETAILED DESCRIPTION OF THE DRAWINGS

Figure 1:
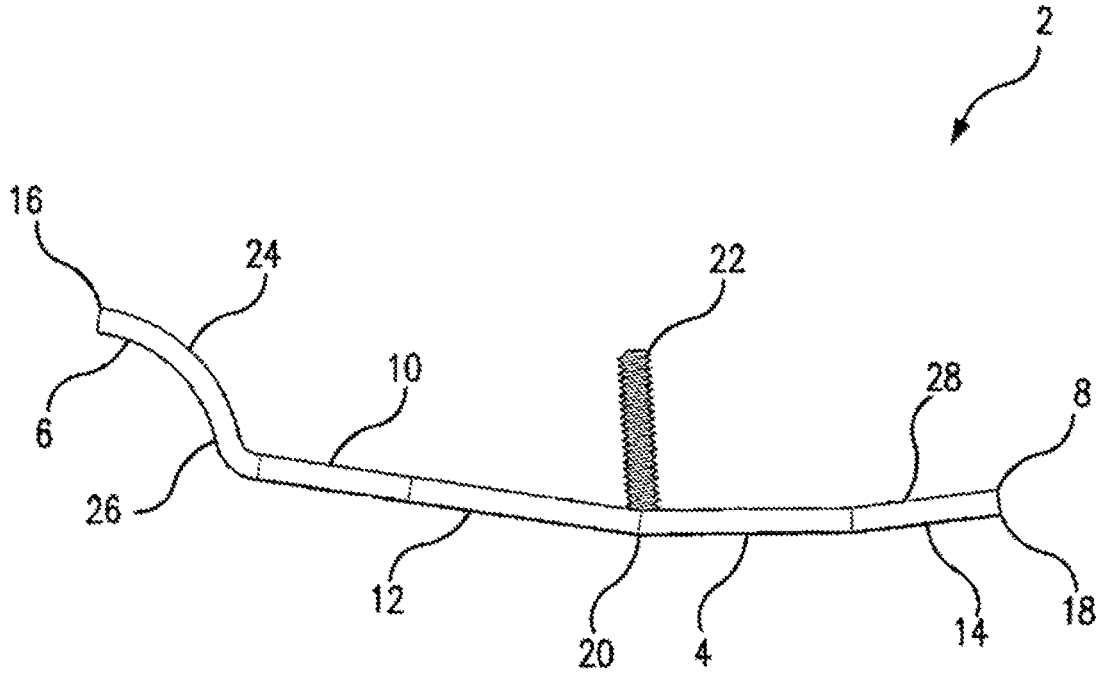
FIG. 1 shows a full side view of the snowmobile ski protector.

FIG. 1 shows the snowmobile ski protector 2 from the side. This ski protector comprises a flat metal plate 4 that has a predetermined thickness, a front end 6, and a back end 8. The flat metal plate 4 is narrower in width than the length of the flat metal plate 4. The flat metal plate 4 has a top surface 10 and fixedly attached to the top surface 10, near a center point 20 thereof, of the flat metal plate 4 is a threaded vertical bolt 22.

The terminal end 24 of the front end 6 of the flat metal plate 4 has an upwardly projecting, forwardly projecting, bent tongue 26.

Figure 2:
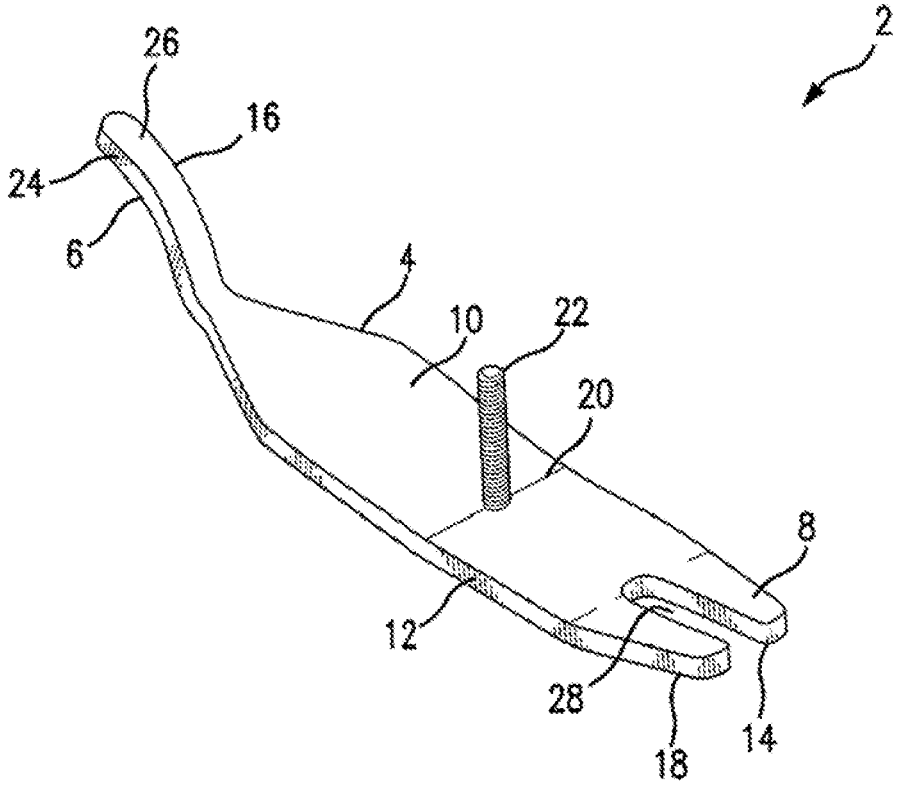
FIG. 2 is a view in perspective from back to front of the snowmobile protector.

FIG. 2 shows the snowmobile protector 2. The flat metal plate 4 has a near end 16 and a distal end 18. The front end 6 has an upwardly projecting, forwardly projecting, bent tongue 26. The back end 8 has a notch 28. The flat metal plate 4 has a top surface wherein there is located a threaded vertical bolt 22. This threaded vertical bolt 22 facilitates attaching of the ski protector 2 to the ski of a snowmobile. The threaded vertical bolt 22 is attached to the top surface of the metal plate 4. The flat metal plate 4 has an outer edge 12 and a bottom 14. The near end 16 contains the upwardly projecting, forwardly projecting, bent tongue 26. The distal end 18 has a notch 28.

Figure 3:
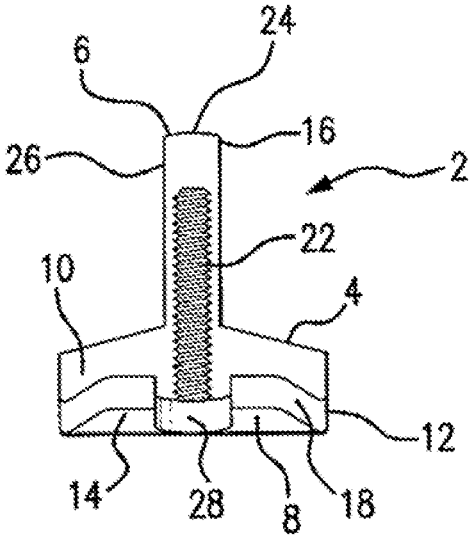
FIG. 3 shows a full back view of the snowmobile protector.

FIG. 3 shows the snowmobile protector 2 from the back end 8. The flat metal plate 4 has a front end 6 and a back end 8. There is also a top surface 10 and an outer edge 12. The bottom 14 is designed to make contact with a surface. The flat plate also has a near end 16, a distal end and a center point. At this center point there is a vertical threaded bolt 22. The terminal end 24 has the upwardly projecting, forwardly projecting, bent tongue 26. The back end 8 has a notch 28.

Figure 4:
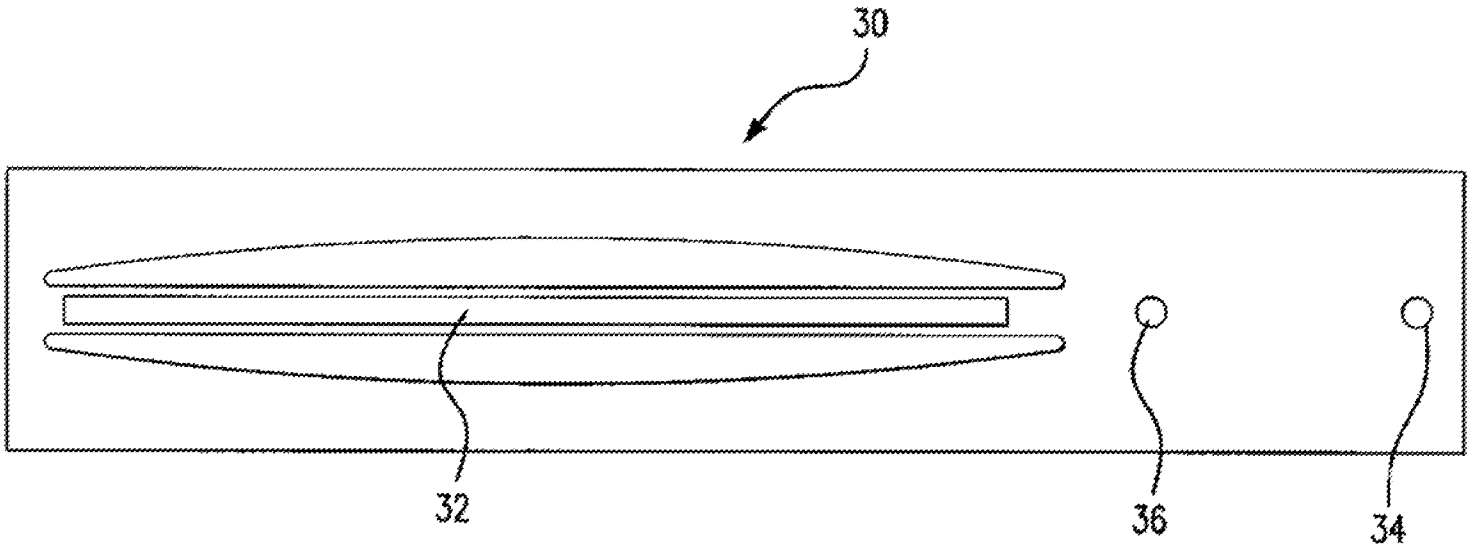
FIG. 4 shows a full view of the bottom of a snowmobile ski without the ski protector installed.

FIG. 4 shows a snowmobile ski 30 without the ski protector 2 installed.

Figure 5:
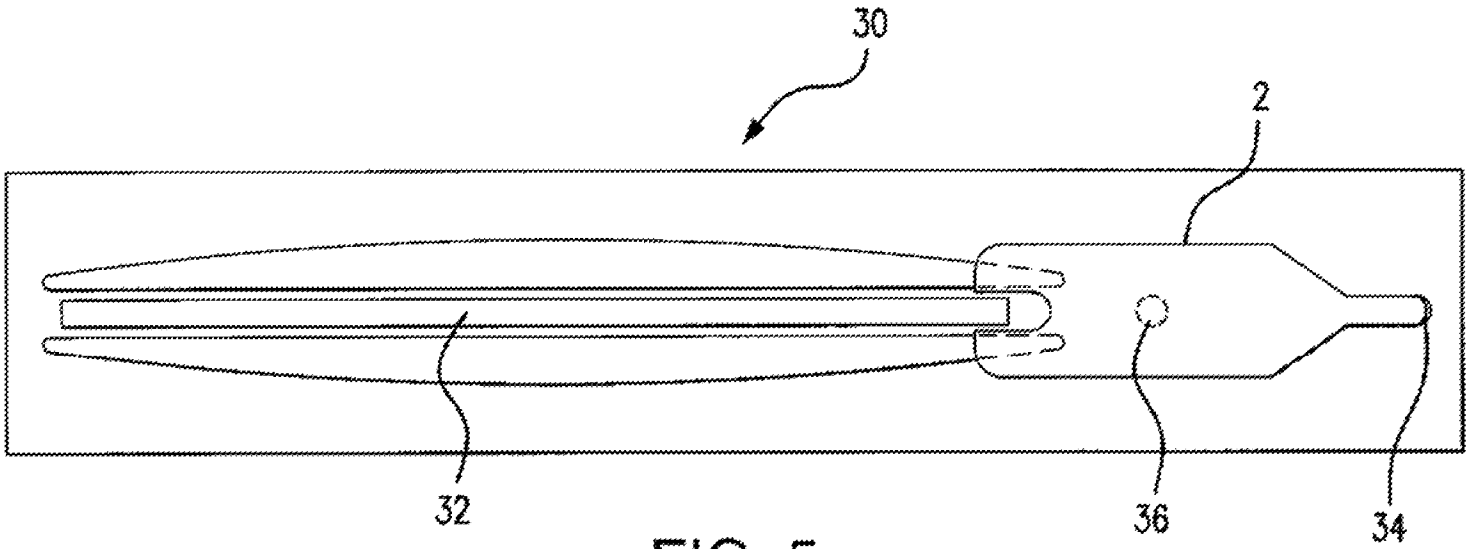
FIG. 5 shows a full view of the bottom of a snowmobile ski with the ski protector installed.

FIG. 5 shows a snowmobile ski 30 with the ski protector 2 installed. The ski protector 2 has a notch 28 that fits over the leading edge of the wear bar 32. There is an opening 34 in the ski 30 for the bent tongue 26 of the ski protector 2. There is a second opening 36 in the ski 30 that accommodates the threaded vertical bolt 22.

The ski protector 2 has an upwardly projecting, forwardly projecting, bent tongue 26 that fits into the first opening of the snowmobile ski 30. The second opening 36 in the snowmobile ski 2 accommodates the threaded vertical post 22 and has a spacer 38 and a nut 40 that tightens the ski protector securely to the snowmobile ski 30.

It has been discovered that when installed the ski protector 2 makes first contact with the terrain therefore protecting the ski and wear bar from damage. It has also been discovered that the ski protector 2 packs down snow in front of the ski which significantly reduces darting. It has also been discovered that installation of the ski protector 2 repairs skis that are already worn out.

In a second embodiment, there is provided a ski protector 45. This ski protector comprises a flat metal plate that has a predetermined thickness, a front end, and a back end.

The flat metal plate is narrower in width than the length of the flat metal plate. The flat metal plate has an opening thorough it near a center point thereof and located within the opening is a threaded vertical bolt.

The terminal end of the front end of the flat metal plate has an upwardly projecting, forwardly projecting, bent tongue.

The back end has a notch through the top surface of the flat metal plate. The notch extends through the thickness of the flat metal plate.

Figure 6:
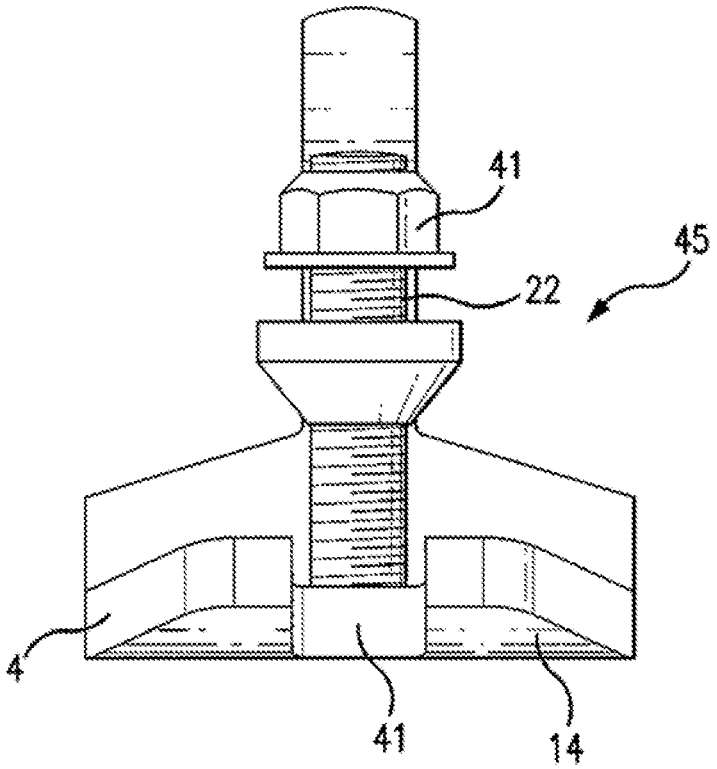
FIG. 6 is a full front end view of the second embodiment of this invention showing the countersunk bolt head.

As can be observed from FIG. 6, the bolt head 41 is countersunk into the bottom 14 of the flat metal plate 4.

What is claimed is:

1. A ski protector, said ski protector comprising i. a flat metal plate having a predetermined thickness, a front end and a back end;

ii. said flat metal plate being narrower in width than a length of said flat metal plate, said flat metal plate having a top surface and fixedly attached to said top surface, at a center point thereof, of said flat metal plate, a threaded vertical bolt;

iii. a terminal end of said front end of said flat metal plate has an upwardly projecting forwardly projecting, bent tongue; and iv. said back end has a notch through said top surface of said flat metal plate, said notch extending through said thickness of said flat metal plate.

2. A ski protector, said ski protector comprising v. a flat metal plate having a predetermined thickness, a front end and a back end; said flat metal plate being narrower in width than a length of said flat metal plate, said flat metal plate has an opening through it at a center point thereof and located within the opening is a threaded vertical bolt;

vii. a terminal end of said front end of said flat metal plate has an upwardly projecting forwardly projecting, bent tongue; and iv. said back end has a notch through said top surface of said flat metal plate, said notch extending through said thickness of said flat metal plate.

* * * * *